US006945617B2

(12) United States Patent
Wong

(10) Patent No.: US 6,945,617 B2
(45) Date of Patent: Sep. 20, 2005

(54) HALF-PRONG WEDGE FOR SLIDING DRAWERS

(75) Inventor: Chong Bin Wong, Vernon Hills, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 10/389,329

(22) Filed: Mar. 14, 2003

(65) Prior Publication Data

US 2004/0178705 A1 Sep. 16, 2004

(51) Int. Cl.[7] ..... A47B 88/00
(52) U.S. Cl. ..... 312/334.1
(58) Field of Search ..... 312/334.1, 334.4, 312/334.5, 334.6, 334.27; 24/453, 297; 384/20, 22; 411/508, 509, 510; 248/220.31

(56) References Cited

U.S. PATENT DOCUMENTS

| | | | | |
|---|---|---|---|---|
| 3,015,869 A | | 1/1962 | Rapata | |
| 3,168,200 A | * | 2/1965 | Larson | 211/194 |
| 4,697,774 A | | 10/1987 | Sarton et al. | 248/221.4 |
| 4,708,895 A | * | 11/1987 | Mizusawa | 428/31 |
| 4,765,036 A | | 8/1988 | Iguchi et al. | 24/289 |
| 4,898,354 A | * | 2/1990 | Whittington et al. | 248/220.22 |
| 4,924,561 A | | 5/1990 | Yoneyama | 24/453 |
| 5,257,861 A | | 11/1993 | Domenig et al. | 312/334.5 |
| 5,362,186 A | * | 11/1994 | Peroni | 411/508 |
| 5,474,378 A | * | 12/1995 | Smith et al. | 312/334.4 |
| 5,513,934 A | * | 5/1996 | German | 411/344 |
| 5,549,376 A | | 8/1996 | Domenig | 312/334.5 |
| 5,597,220 A | * | 1/1997 | Domenig et al. | 312/334.4 |
| 5,657,878 A | * | 8/1997 | Austin | 211/41.8 |
| 5,746,490 A | | 5/1998 | Domenig | 312/334.5 |
| 5,823,648 A | | 10/1998 | Domenig | 312/334.5 |
| 5,881,982 A | * | 3/1999 | Hollingsworth et al. | 248/220.31 |
| 5,927,841 A | | 7/1999 | Ferrari et al. | 312/348.1 |
| 6,019,328 A | * | 2/2000 | Allen | 248/220.31 |
| 6,042,206 A | * | 3/2000 | Bowyer et al. | 312/350 |
| D469,001 S | * | 1/2003 | Branson, Jr. | D8/374 |
| 2003/0111941 A1 | * | 6/2003 | Noel et al. | 312/334.4 |

FOREIGN PATENT DOCUMENTS

| | | | | |
|---|---|---|---|---|
| GB | 2242700 A | * | 10/1991 | F16B/17/00 |

* cited by examiner

*Primary Examiner*—Peter M. Cuomo
*Assistant Examiner*—Stephen D'Adamo
(74) *Attorney, Agent, or Firm*—Mark W. Croll, Esq.; Paul F. Donovan, Esq.; Welsh & Katz, Ltd.

(57) ABSTRACT

A drawer guide for supporting a drawer found in a desk, cabinet, appliance or other articles of furniture includes a drawer guide body defining a wall having on a first side an outwardly extending wedge, a half-prong integral with the wedge, and a support rib spaced apart from the wedge. The half-prong includes a flexible latching member extending downwardly from the wedge. The wall of the drawer guide body has on a second side a drawer mounting track for slidably receiving and mounting the drawer. The drawer guide of the invention is mountable to a pair of openings in a panel on the desk, cabinet, or appliance. Specifically, the wedge, half-prong, and flexible latching member will extend through one opening in the panel with the flexible latching member causing the drawer guide to snap fit to the panel and with the flexible latching member preventing the drawer guide from withdrawing from the panel. In addition, the support rib will extend through a second opening in the panel to support the weight of the drawer guide and the mounted drawer.

13 Claims, 5 Drawing Sheets

HALF-PRONG WEDGE FOR SLIDING DRAWERS

FIELD OF THE INVENTION

The present invention relates generally to sliding drawers and more particularly to a device for supporting and guiding a sliding drawer.

BACKGROUND OF THE INVENTION

Various types of drawer guides for supporting and guiding a drawer of an appliance, desk or cabinet are well known. The known drawer guides are typically molded from a plastic material to define generally a drawer mounting track on which the drawer is placed. Known drawer guides also include components for mounting the drawer guide to a panel on the appliance, desk or cabinet. The known components for mounting the drawer guide to the panel include complex mounting brackets and the use of fasteners. Although known drawer guides have been satisfactory for their intended purposes, problems do exist with respect to such drawer guides and specifically the known components for mounting the drawer guides to the panel of the appliance, desk or cabinet. For instance, the drawer guides using the complex mounting components can be difficult to assemble onto the panel. In addition, because of the use of these complex mounting components, the drawer guide can have a relatively high manufacturing and assembly cost.

The present invention is directed at overcoming these and other known problems and disadvantages with existing drawer guides.

SUMMARY OF THE INVENTION

The present invention includes a drawer guide for use in mounting a drawer to an article of furniture, such as, an appliance, desk, cabinet, or similar article. The drawer guide of the present invention reduces the complexity of known drawer guides by combining and relocating several mounting components. The mounting components of the present invention extend through an opening in the panel of the article of furniture and serve to snap-fit the drawer guide to the panel. In addition, the drawer guide includes a support component to support the weight of the drawer guide and the mounted drawer. The present invention is simpler in design than known drawer guides, thereby resulting in improved assembly of the drawer guide to the article of furniture and also reduced manufacturing costs.

Other features and advantages of the invention will become apparent to those skilled in the art upon review of the following detailed description, claims and drawings in which like numerals are used to designate like features.

Figure 1:
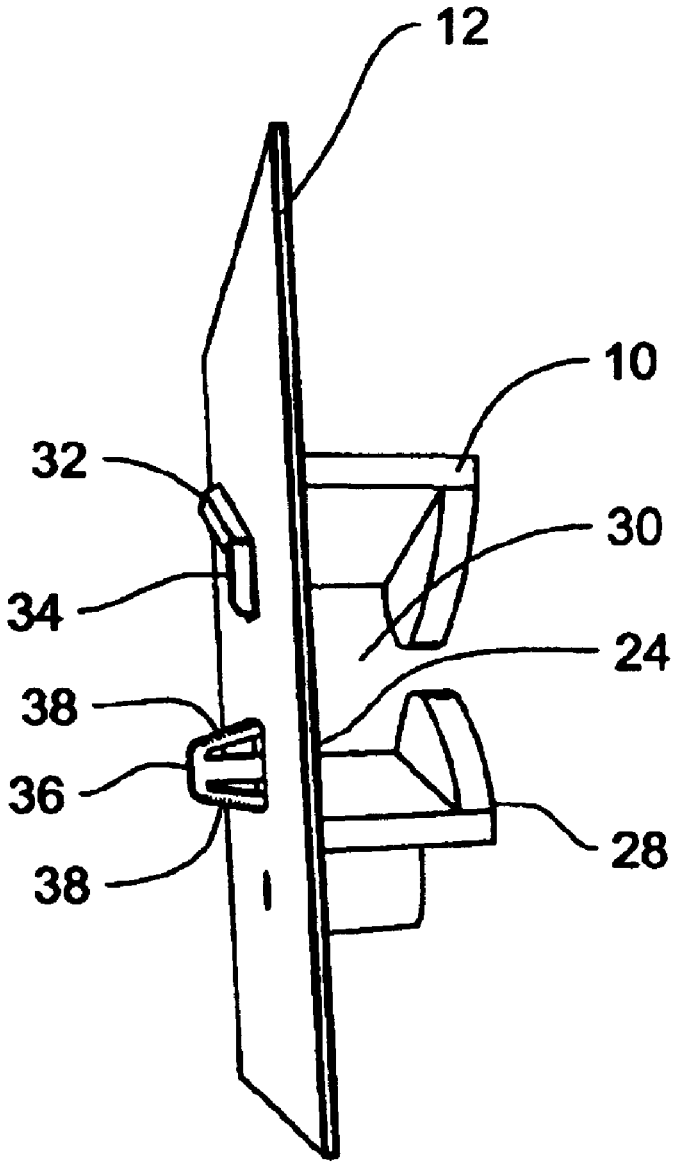
FIG. 1 (Prior Art)
FIG. 1 is a side elevation view of a prior art drawer guide mounted to a panel.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "compromising" and variations thereof is meant to encompass the items listed thereafter and equivalents thereof as well as additional items and equivalents thereof.

DETAILED DESCRIPTION OF THE PREFERRED EMBODIMENTS

Figure 2:
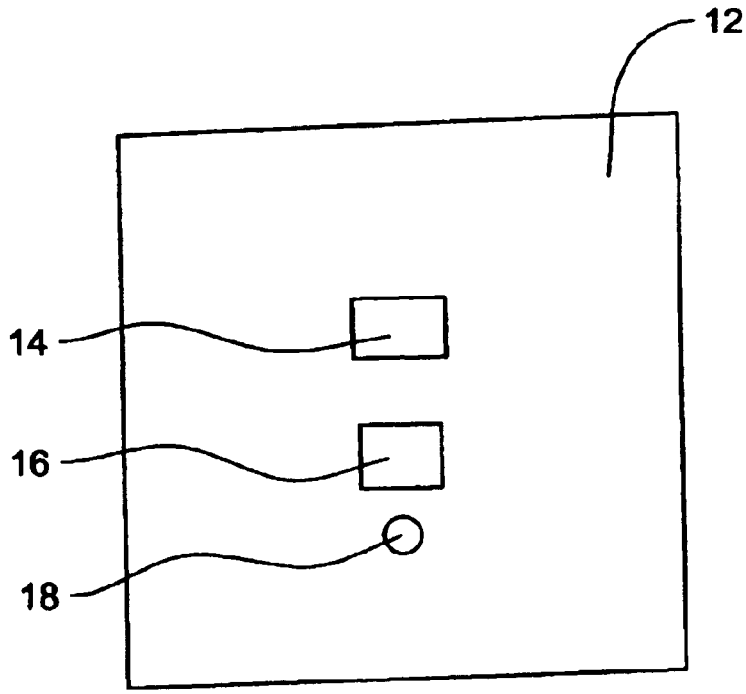
FIG. 2 (Prior Art)
FIG. 2 is front elevation view of the prior art panel of FIG. 1.
Figure 3:
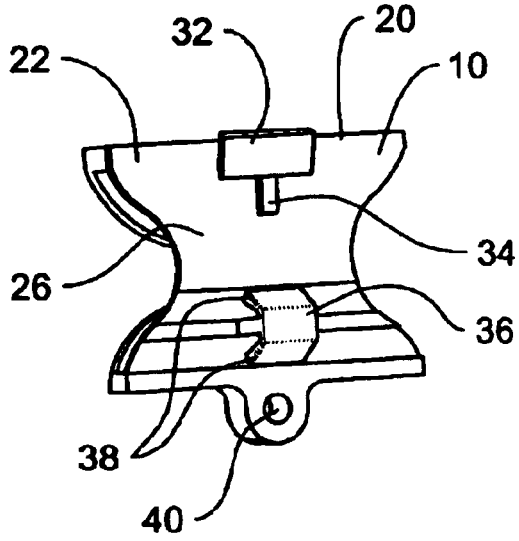
FIG. 3 (Prior Art)
FIG. 3 is a back elevation view of the prior art drawer guide of FIG. 1.

Referring to FIGS. 1–4, there is depicted a prior art drawer guide 10 that is mountable to a panel 12 of an appliance, cabinet, desk or similar article of furniture. As shown in FIG. 2, the panel 12 includes rectangular shaped cutouts 14, 16 to receive and mount the drawer guide 10, and a hole 18, which can be threaded, for fastening the drawer guide 10 onto the panel 12. As depicted in FIGS. 1 and 3, the known drawer guide 10 defines a molded drawer guide body 20 that includes a wall 22 having an inner side 24 and an outer side 26. On the inner side 24, the drawer guide body 20 includes a drawer glide 28 that defines a C-shaped profile and a channel 30 to slidably receive and mount a drawer, not shown. The C-shaped profile of the drawer glide 28 retains the drawer within the channel 30 of the drawer glide 28. On the outer side 26 of the wall 22 of the drawer guide body 20 is a wedge 32 for use in anchoring the drawer guide 10 to the panel 12, a support rib 34 for use in supporting the drawer guide 10 on the panel 12, and a W-shaped prong 36 having flexible opposing latching members 38 for snap fitting the drawer guide 10 onto the panel 12, as shown in FIG. 1. A hole 40 is located on one end of the drawer guide body 20 and aligns with the hole 18 on the panel 12. The hole 40 receives a fastener, not shown, which further secures the drawer guide 10 to the panel 12 via the hole 18.

Figure 4:
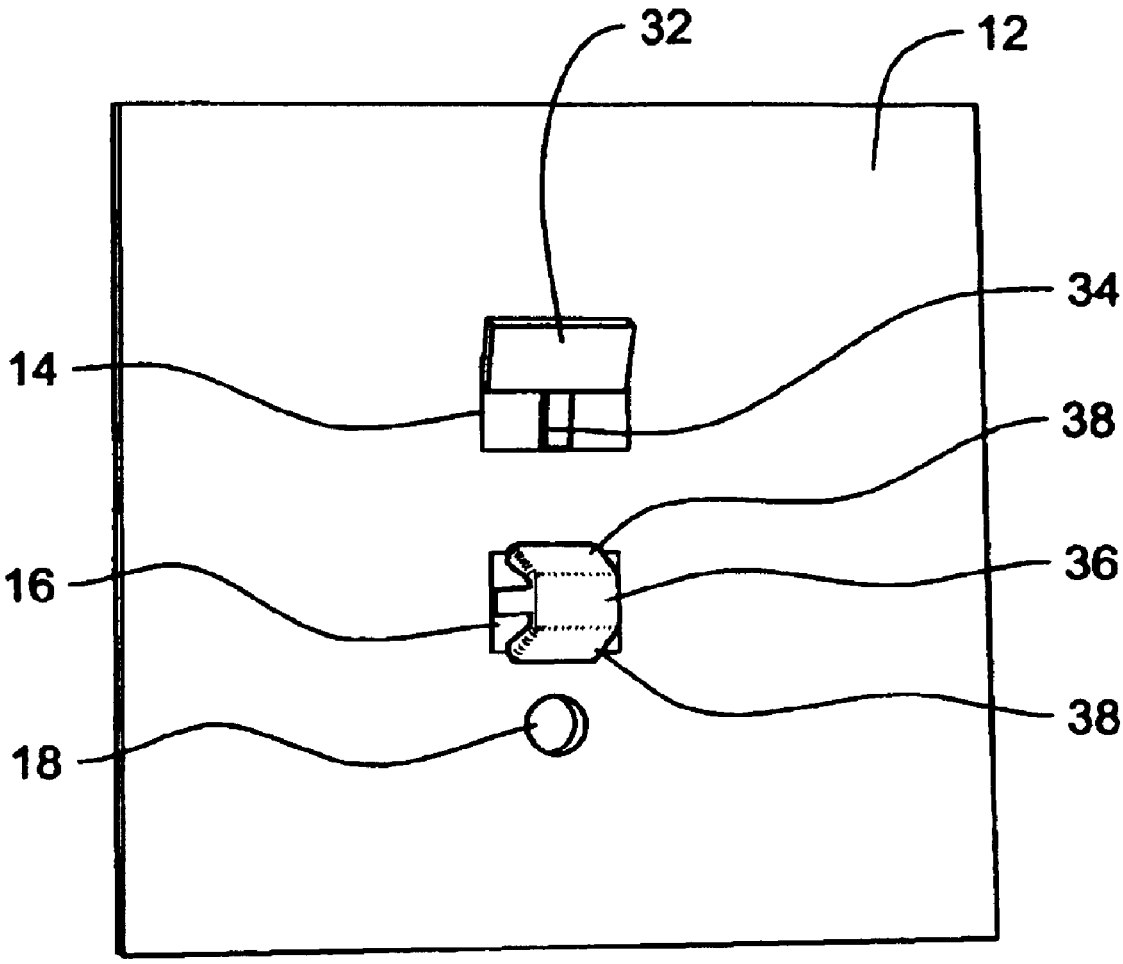
FIG. 4 (Prior Art)
FIG. 4 is a back elevation view of the prior art drawer guide mounted to the prior art panel of FIG. 1.

Referring to FIGS. 1 and 4, to install the drawer guide 10 to the panel 12, the wedge 32 is first inserted at an angle into the cutout 14. The top surface of the wedge 14 contacts the top surface of the cutout 14 and serves as a pivot as the drawer guide 10 is rotated closer to the panel 12. As the drawer guide 10 is rotated closer to the panel 12, the W-shaped prong 36 will fit into the cutout 16 and the flexible opposing latching members 38 will compress until the W-shaped prong 36 passes through the cutout 16. Once through the cutout 16, the opposing latching members 38 will expand causing the W-shaped prong to snap fit into the cutout 16. The opposing latching members 38 will prevent the drawer guide 10 from withdrawing from the panel 12 by engaging the back surface of the panel 12. The rib 34, which is positioned immediately below the wedge 36, seats in the cutout 14 to generally support the weight of the drawer guide 10 and the drawer that is mounted on the drawer guide 10.

Figure 5:
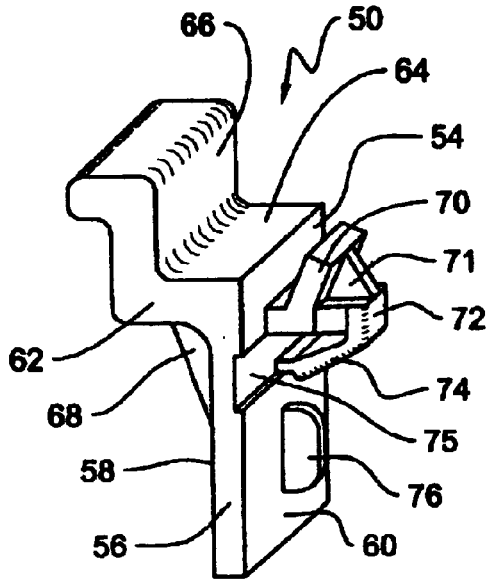
FIG. 5 is an isometric view of the drawer guide of the present invention.
Figure 6:
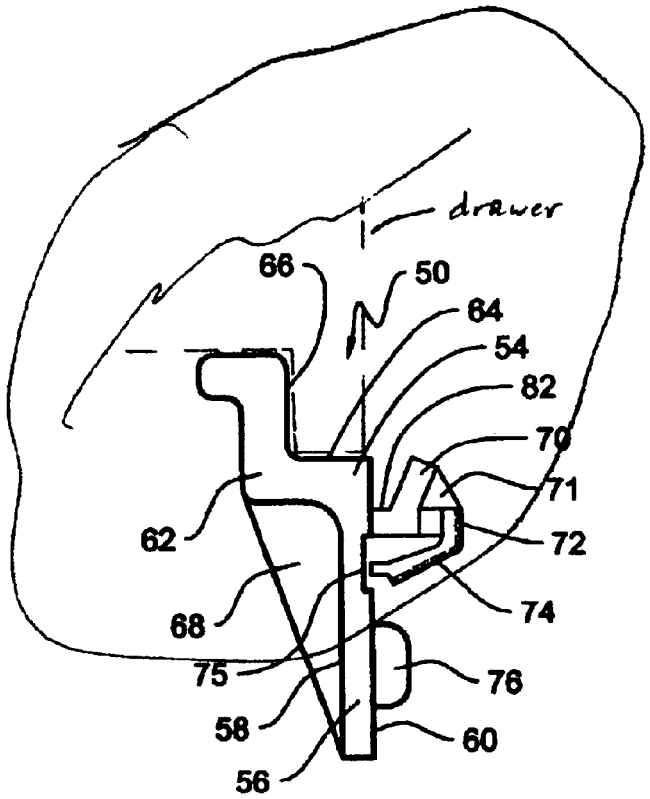
FIG. 6 is a side elevation view of the drawer guide of FIG. 5.

Referring to FIGS. 5–8, there is depicted an embodiment of the drawer guide 50 of the present invention. The drawer guide 50 is preferably a molded part made from a plastic material, or other suitable material. The drawer guide 50 is mountable to a panel 52 of a cabinet, desk, appliance, or other similar article of furniture on which a drawer may be mounted. The drawer guide 50 defines a drawer guide body 54 that includes a wall 56 having an inner side 58 and an outer side 60. Located on the inner side 58 of the wall 56 of the drawer guide body 54 is a drawer mounting track 62 that, as shown in FIGS. 5 and 6, extends outwardly and upwardly from the drawer guide body 54 to slidably receive and support a drawer, not shown. The drawer-mounting track 62 defines a drawer support surface 64 on which the drawer is placed or mounted. The drawer-mounting track 62 further defines a drawer support wall 66 extending perpendicular to the drawer support surface 64 for containing the drawer on the drawer support surface 64. A support gusset 68 is positioned below the drawer-mounting track 62 to support the drawer support surface 64 of the drawer-mounting track 62 to further assist in supporting the weight of the drawer.

Figure 8:
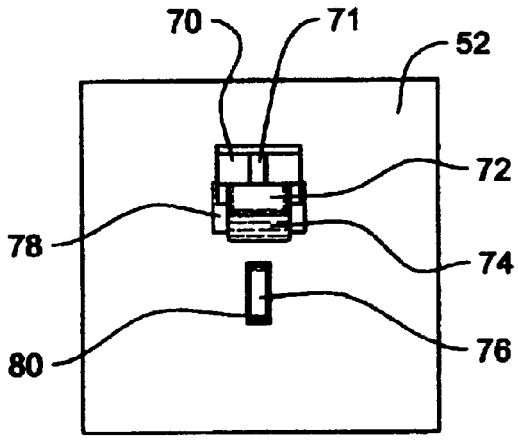
FIG. 8 is a back elevation view of the drawer guide of FIG. 5 mounted to the panel of FIG. 7.

Referring to FIGS. 5, 6, and 8, located on the outer side 60 of the wall 56 of the drawer guide body 54 is a wedge 70 for use in mounting and anchoring the drawer guide 50 to the panel 52. As shown in FIGS. 5 and 6, the wedge 70 extends outwardly and angularly upward from the plane of the wall 56. A reinforcing gusset 71 is positioned on the back surface of the angularly upward portion of the wedge 70 for providing support for the wedge 70. The wedge 70 includes an integral half-prong 72 extending outwardly from the wedge 70 and is further joined to the wedge 70 via the reinforcing gusset 71. The half-prong 72 includes a flexible latching member 74 that extends downwardly from the wedge 70 for use in snap fitting the drawer guide 50 onto the panel 52, discussed below. A horizontally extending channel 75 is formed in the outer side 60 of the wall 56 immediately below the wedge 70 to provide an additional clearance for the latching member 74. Also located on the outer side 60 of the drawer guide body 54 is a support rib 76 that is positioned below the half-prong 72 of the wedge 70 and is spaced apart from the half-prong 72. The support rib 76 is preferably rectangular shaped and vertically extending and serves to support the drawer guide 50 and also the weight of the drawer mounted on the drawer guide 50.

Figure 7:
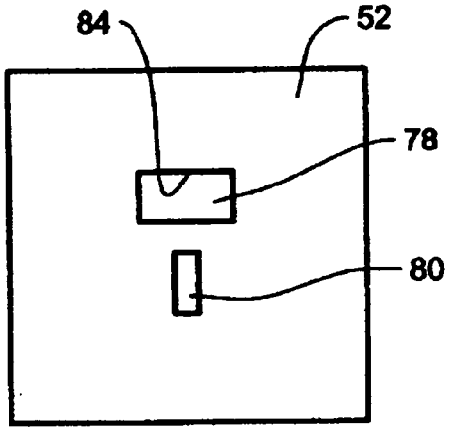
FIG. 7 is a front elevation view of a panel on which the drawer guide of FIG. 5 is mounted.

Referring to FIG. 7, the panel 52 includes an opening 78 sized and shaped to receive the wedge 70 and extending latching member 74 of the half-prong 72. The panel 52 further includes an opening 80 sized and shaped to receive the support rib 76.

The drawer guide 50 is installed in a manner similar to the known drawer guide 10. That is, the wedge 70 of the drawer guide 50 is first inserted at an angle into the opening 78. Referring to FIGS. 6–8, the top portion 82 of the wedge 70 contacts the top surface 84 of the opening 78 and serves as a pivot as the drawer guide 50 is rotated closer to the panel 52. As the drawer guide 50 is rotated closer to the panel 52, the support rib 76 will fit into the opening 80, while the wedge 70, half-prong 72, and latching member 74 will fit into the opening 78 and will snap fit into the opening 78 once the outer side 60 of the wall 56 of the drawer guide 50 is positioned flat onto the panel 52. Specifically, and in more detail, as the wedge 70 and half-prong 72 pass through the opening 78, the flexible latching member 74 of the half-prong 72 will compress until the half-prong 72 passes through the opening 78. Once through the opening 78, the flexible latching member 74 will expand causing the half-prong 72 to snap fit into the opening 78. Once expanded, the latching member 74 will prevent the drawer guide 50 from withdrawing from the panel 52 by engaging the back surface of the panel 52. As stated, the support rib 76 will seat in the opening 80 to generally support the weight of the drawer guide 50 and the drawer mounted on the drawer guide 50. Once the drawer guides 50 are installed, the drawer may be slidably mounted on the drawer-mounting track 62 of each of the drawer guides 50.

Figure 9:
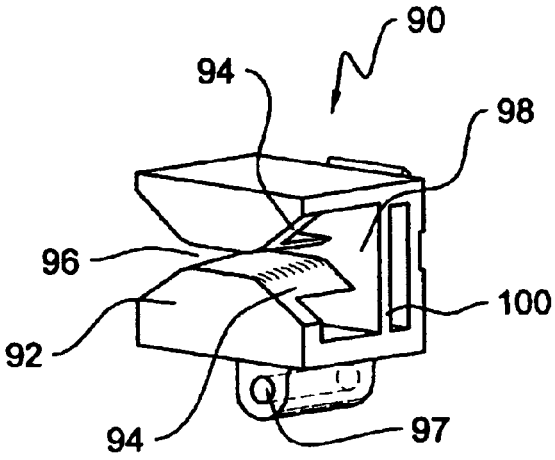
FIG. 9 is an isometric view of an alternative embodiment of the drawer guide of FIG. 5.
Figure 10:
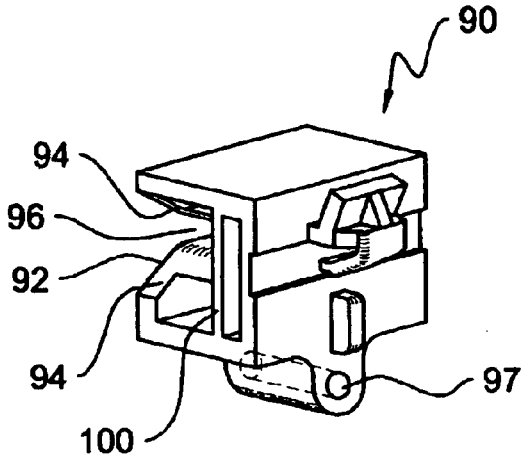
FIG. 10 is an isometric view of the alternative embodiment of FIG. 9.
Figure 11:
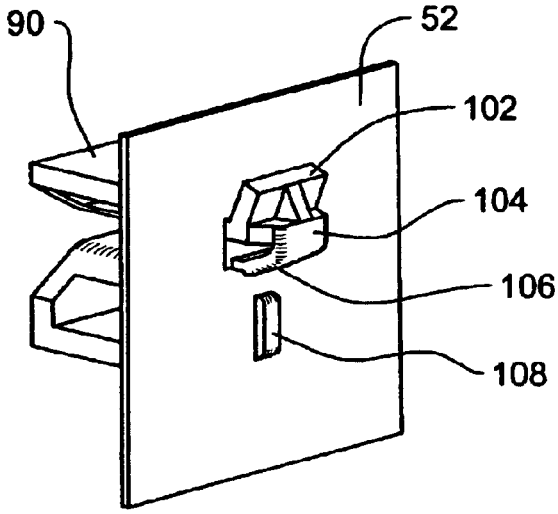
FIG. 11 is an isometric view of the alternative embodiment of FIG. 9 mounted to a panel.

Referring to FIGS. 9–11, another exemplary embodiment of the present invention is a drawer guide 90 that includes a drawer-mounting track 92 located on the inner side 98 of the wall 100 of the drawer guide 90. The drawer-mounting track 92 defines a pair of opposing curve-shaped surfaces 94 that form a channel 96 between the opposing surfaces 94. The curve-shaped surfaces 94 and channel 96 slidably receive, mount, and contain the drawer, not shown. Positioned below the drawer-mounting track 92 is a cylindrical mounting hole 97 to permit the fastening of the drawer guide 92 to the panel 52, as known in the art. The remaining structure of the drawer guide 92 is common with the drawer guide 50, described above, and therefore will not be repeated. As shown in FIG. 11, the drawer guide 90 is mounted to the panel 52 in the same manner described above and as depicted in FIG. 8. Similarly, like the drawer guide 50, the drawer guide 90 also includes the use of a wedge 102, integral half prong 104, flexible latching member 106, and support rib 108 to provide the unique mounting of the drawer guide 90 to the panel 52. One of skill in the art will understand and appreciate that other shapes, designs and configurations of the drawer-mounting track 62 and 90 are possible with the unique mounting configuration of the present invention.

Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art. Various features of the invention are set forth in the following claims.

What is claimed is:

1. A drawer guide for use in supporting an associated drawer, the drawer guide comprising:

a drawer guide body defining a wall, the wall having an inner side and an outer side, the outer side including an integral wedge and a half-prong integral with the wedge, the body including a reinforcing gusset between and integral with the half-prong and the wedge, the half-prong including a latching member extending outwardly from the wedge, the outer side of the wall further including a support rib spaced apart from the half-prong, and the inner side of the wall including a drawer-mounting track for receiving the associated drawer, the wedge extending outwardly and angularly upwardly from the outer side of the wall, the wall including a recess formed therein opposite of and for accommodating the latching member as the latching member is flexed inward, and wherein the reinforcing gusset has an open side and is oriented transverse to the latching member flexing direction, the reinforcing gusset having a planar, non-flanged edge.

2. The drawer guide as set forth in claim 1, wherein the latching member is flexible and extends downwardly from the wedge.

3. The drawer guide as set forth in claim 1, wherein drawer-mounting track extends outwardly from the inner side of the wall.

4. The drawer guide as set forth in claim 3, wherein a support gusset is positioned below the drawer-mounting track.

5. The drawer guide as set forth in claim 3, wherein the drawer-mounting track further includes a drawer support surface for slidably receiving the associated drawer, and a drawer support wall extending perpendicularly to the drawer support surface for containing the associated drawer on the drawer support surface.

6. A drawer guide for mounting an associated drawer, the drawer guide being mountable to a panel, the panel defining a first and second opening for receiving the drawer guide, the drawer guide comprising:

a drawer guide body defining a wall, the wall having an inner side and an outer side, the outer side including a wedge and a half-prong integral with the wedge, body including a reinforcing gusset between and integral with the half-prong and the wedge, the half prong including a flexible latching member extending downwardly from the wedge, the inner side of the wall including a drawer-mounting track for receiving the associated drawer, the wedge extending outwardly and angularly upwardly from the outer side of the wall, the wall including a recess formed therein opposite of and for accommodating the latching member as the latching member is flexed inward, and wherein the reinforcing gusset has an open side and is oriented transverse to the latching member flexing direction, the reinforcing gusset having a planar, non-flanged edge.

7. The drawer guide as set forth in claim 6, wherein the outer side of the wall further includes a support rib positioned below and spaced apart on the half-prong.

8. The drawer guide as set forth in claim 6, wherein a support gusset is positioned below the drawer-mounting track.

9. The drawer guide as set forth in claim 6, wherein the drawer-mounting track further includes a drawer support surface for slidably receiving the associated drawer, and a drawer support wall extending perpendicular to the drawer support surface for containing the associated drawer on the drawer support surface.

10. The drawer guide as set forth in claim 6, wherein the wedge and half-prong are received in the first opening in the panel, and the support rib is received in the second opening in the panel.

11. A drawer guide for mounting an associated drawer, the drawer guide being mountable to a panel of an article of furniture, the panel defining first and second openings for receiving the drawer guide, the drawer guide comprising:

a drawer guide body defining a wall, the wall having an inner side and an outer side, the outer side including a wedge and a half-prong integral with the wedge, the body including a reinforcing gusset between and integral with the half-prong and the wedge, the wedge extending outwardly and angularly upward from the outer side of the wall, the half-prong including a flexible latching member extending downwardly from the wedge, the inner side of the wall including a drawer-mounting track for receiving the associated drawer, the wall including a recess formed therein opposite of and for accommodating the latching member as the latching member is flexed inward, and wherein the reinforcing gusset has an open side and is oriented to the latching member flexing direction, the reinforcing gusset having a planar, non-flanged edge.

12. The drawer guide as set forth in claim 11, wherein the outer side of the wall further includes a support rib spaced apart from the half-prong.

13. The drawer guide as set forth in claim 13, wherein the wedge and half-prong are received in the first opening in the panel, and the support rib is received in the second opening in the panel.

* * * * *

UNITED STATES PATENT AND TRADEMARK OFFICE

CERTIFICATE OF CORRECTION

PATENT NO. : 6,945,617 B2
DATED : September 20, 2005
INVENTOR(S) : Chong Bin Wong It is certified that error appears in the above-identified patent and that said Letters Patent is hereby corrected as shown below:

Column 5,
Line 1, should read -- The drawer guide as set forth in claim 1, wherein the drawer-mounting… --.
Line 19, should read -- ...half-prong integral with the wedge, the body including… --.

Signed and Sealed this

Sixth Day of December, 2005

JON W. DUDAS
*Director of the United States Patent and Trademark Office*